US010347411B2

(12) United States Patent
Deligianni et al.

(10) Patent No.: US 10,347,411 B2
(45) Date of Patent: Jul. 9, 2019

(54) STRESS MANAGEMENT SCHEME FOR FABRICATING THICK MAGNETIC FILMS OF AN INDUCTOR YOKE ARRANGEMENT

(71) Applicant: International Business Machines Corporation, Armonk, NY (US)

(72) Inventors: Hariklia Deligianni, Alpine, NJ (US); Bruce B. Doris, Slingerlands, NY (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/599,754

(22) Filed: May 19, 2017

(65) Prior Publication Data

US 2018/0336991 A1 Nov. 22, 2018

(51) Int. Cl.
*H01F 7/06* (2006.01)
*H01F 27/245* (2006.01)
*H01F 41/02* (2006.01)

(52) U.S. Cl.
CPC ..... *H01F 27/245* (2013.01); *H01F 41/02* (2013.01)

(58) Field of Classification Search
CPC ..... H01F 27/2804; H01F 27/245; H01F 2027/2809; H01F 41/0206; H01F 1/14766; H01F 1/14708
See application file for complete search history.

(56) References Cited

U.S. PATENT DOCUMENTS 5,756,201 A 5/1998 Kadono et al.
6,184,143 B1 2/2001 Ohashi et al.
6,346,336 B1 2/2002 Nago
6,759,297 B1 7/2004 Dvorsky et al.
6,982,196 B2 * 1/2006 Belyansky ..... H01L 21/823807 257/E21.633
7,202,516 B2 * 4/2007 Belyansky ..... H01L 21/823807 257/204

(Continued)

OTHER PUBLICATIONS

Deligianni et al., "Laminated Magnetic Inductor Stack With High Frequency Peak Quality Factor", U.S. Appl. No. 15/479,615, filed Apr. 5, 2017.

(Continued)

*Primary Examiner* — Paul D Kim
(74) *Attorney, Agent, or Firm* — Cantor Colburn LLP; Vazken Alexanian

(57) ABSTRACT

Embodiments of the invention are directed to a method of fabricating a yoke arrangement of an inductor. A non-limiting example method includes forming a dielectric layer across from a major surface of a substrate. The method further includes configuring the dielectric layer such that it imparts a predetermined dielectric layer compressive stress on the substrate. A magnetic stack is formed on an opposite side of the dielectric layer from the substrate, wherein the magnetic stack includes one or more magnetic layers alternating with one or more insulating layers. The method further includes configuring the magnetic stack such that it imparts a predetermined magnetic stack tensile stress on the dielectric layer, wherein a net effect of the predetermined dielectric layer compressive stress and the predetermined magnetic stack tensile stress on the substrate is insufficient to cause a portion of the major surface of the substrate to be substantially non-planar.

14 Claims, 6 Drawing Sheets

(56) References Cited

U.S. PATENT DOCUMENTS

| | | | | |
|---|---|---|---|---|
| 7,238,990 | B2 | 7/2007 | Burnett et al. | |
| 7,737,052 | B2 | 6/2010 | Bhatia et al. | |
| 7,906,383 | B2 | 3/2011 | Richter et al. | |
| 8,299,615 | B2 | 10/2012 | Fayaz et al. | |
| 9,412,866 | B2 | 8/2016 | Kuoh et al. | |
| 2016/0086960 | A1 | 3/2016 | Wen et al. | |
| 2018/0005741 | A1* | 1/2018 | Doris | H01F 3/02 |
| 2018/0197670 | A1* | 7/2018 | Deligianni | H01F 27/2804 |
| 2018/0197671 | A1* | 7/2018 | Deligianni | H01F 27/2804 |

OTHER PUBLICATIONS

Deligianni et al., "Magnetic Inductor Stack Including Insulating Material Having Multiple Thicknesses," U.S. Appl. No. 15/584,766, filed May 2, 2017.

Deligianni et al., "Magnetic Inductor Stack Including Magnetic Materials Having Multiple Permeabilities," U.S. Appl. No. 15/494,871, filed Apr. 24, 2017.

Deligianni et al., "Magnetic Inductor Stack Including Magnetic Materials Having Multiple Permeabilities," U.S. Appl. No. 15/966,202, filed Apr. 30, 2018.

Deligianni et al., "Magnetic Inductor Stacks," U.S. Appl. No. 15/403,292, filed Jan. 11, 2017.

Deligianni et al., "Magnetic Inductor Stacks," U.S. Appl. No. 15/800,702, filed Nov. 1, 2017.

Deligianni et al., "Magnetic Inductor With Multiple Magnetic Layer Thicknesses," U.S. Appl. No. 15/473,725, filed Mar. 30, 2017.

Deligianni et al., "Magnetic Inductor With Shape Anisotrophy", U.S. Appl. No. 15/476,147, filed Mar. 31, 2017.

List of IBM Patents or Patent Applications Treated as Related; Date Filed: May 19, 2017, 2 pages.

Deligianni et al., "Stress Management for Thick Magnetic Film Inductors," U.S. Appl. No. 16/107,102, filed Aug. 21, 2018.

* cited by examiner

STRESS MANAGEMENT SCHEME FOR FABRICATING THICK MAGNETIC FILMS OF AN INDUCTOR YOKE ARRANGEMENT

BACKGROUND

The present invention relates generally to fabrication methods and resulting structures for semiconductor devices. More specifically, the present invention relates to stress management schemes for forming relatively thick magnetic films of an inductor.

Inductors, resistors, and capacitors are the main passive elements in electronic circuits. Inductors are used in circuits for a variety of purposes, such as in noise reduction, inductor-capacitor (LC) resonance calculators, and power supply circuitry. Inductors can be configured as a closed yoke design or a solenoid design. Closed yoke inductors have magnetic material wrapped around copper wires, and solenoid inductors have copper wire wrapped around magnetic material. In semiconductor-based integrated circuits (ICs), the performance of both inductor types benefit from forming the magnetic material from relatively thick magnetic materials.

SUMMARY

Embodiments of the invention are directed to methods of fabricating a yoke arrangement of an inductor. A non-limiting example method includes forming a dielectric layer across from a major surface of a substrate. The method further includes configuring the dielectric layer such that it imparts a predetermined dielectric layer compressive stress on the substrate. A magnetic stack is formed on an opposite side of the dielectric layer from the substrate, wherein the magnetic stack includes one or more magnetic layers alternating with one or more insulating layers. The method further includes configuring the magnetic stack such that it imparts a predetermined magnetic stack tensile stress on the dielectric layer, wherein a net effect of the predetermined dielectric layer compressive stress and the predetermined magnetic stack tensile stress on the substrate is insufficient to cause a portion of the major surface of the substrate to be substantially non-planar.

Embodiments of the invention are directed to yoke arrangements of an inductor. A non-limiting example yoke arrangement includes a dielectric layer across from a major surface of a substrate, wherein the dielectric layer is configured to impart a predetermined dielectric layer compressive stress on the substrate. A magnetic stack is on an opposite side of the dielectric layer from the substrate, wherein the magnetic stack includes one or more magnetic layers alternating with one or more insulating layers, and wherein the magnetic stack is configured to impart a predetermined magnetic stack tensile stress on the dielectric layer. A net effect of the predetermined dielectric layer compressive stress and the predetermined magnetic stack tensile stress on the substrate is insufficient to cause a portion of the major surface of the substrate to be substantially non-planar.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification.

The foregoing and other features and advantages of the embodiments of the invention are apparent from the following detailed description taken in conjunction with the accompanying drawings in which.

Figure 1:
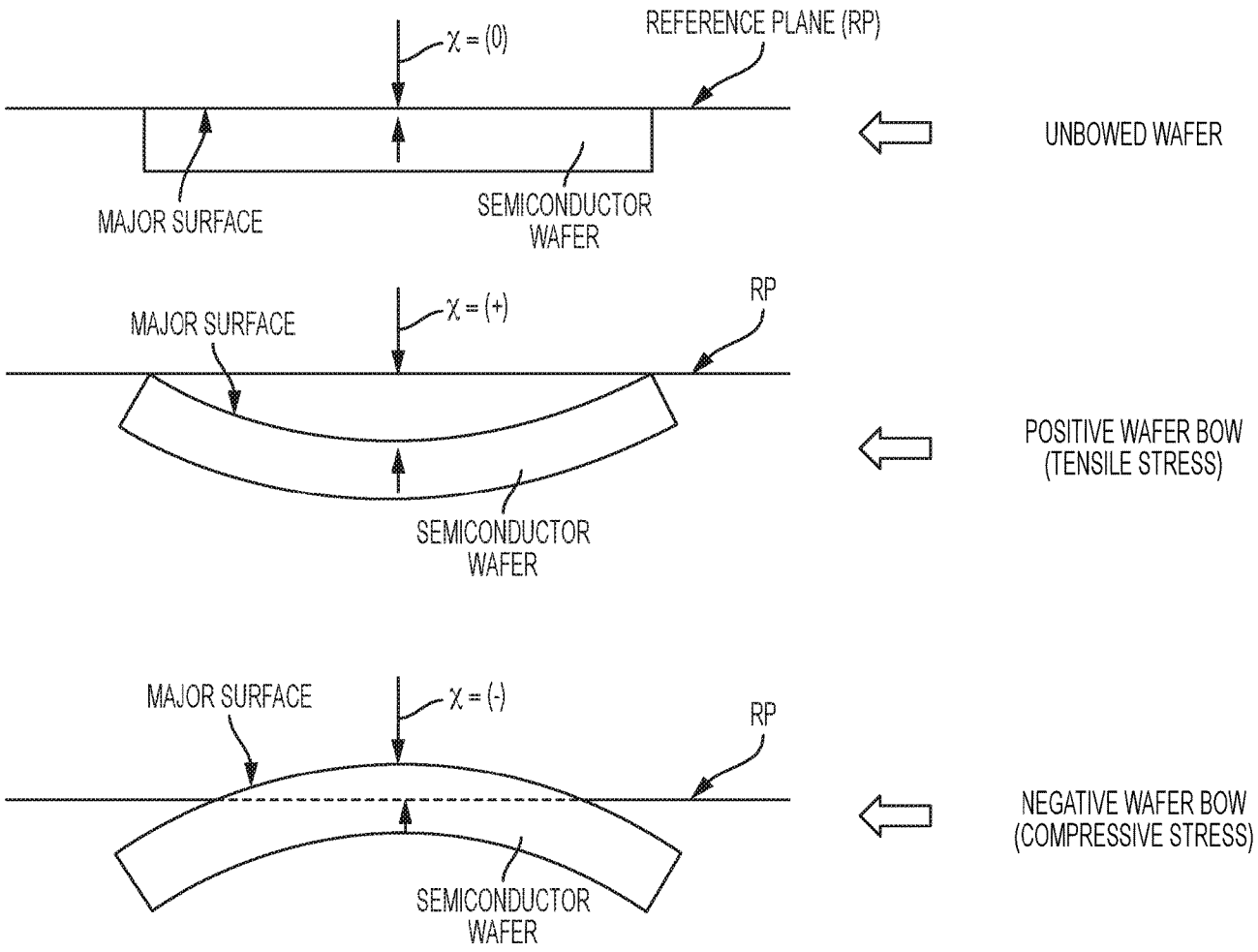
FIG. 1 depicts diagrams illustrating examples of a substantially unbowed wafer, a negatively bowed wafer, and a positively bowed wafer.

The diagrams depicted herein are illustrative. There can be many variations to the diagram or the operations described therein without departing from the spirit of the invention. For instance, the actions can be performed in a differing order or actions can be added, deleted or modified.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Similarly, the term "coupled" and variations thereof describes having a communications path between two elements and does not imply a direct connection between the elements with no intervening elements/connections between them. All of these variations are considered a part of the specification. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

Spatially relative terms, e.g., "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

For the sake of brevity, conventional techniques related to semiconductor device and integrated circuit (IC) fabrication may or may not be described in detail herein. Moreover, the various tasks and process steps described herein can be incorporated into a more comprehensive procedure or process having additional steps or functionality not described in detail herein. In particular, various steps in the manufacture of laminated inductor devices are well known and so, in the interest of brevity, many conventional steps will only be mentioned briefly herein or will be omitted entirely without providing the well-known process details.

Turning now to an overview of technologies that are more specifically relevant to aspects of the invention, as previously noted herein, inductors, resistors, and capacitors are the main passive elements in electronic circuits. Inductors are used in circuits for a variety of purposes, such as in noise reduction, inductor-capacitor (LC) resonance calculators, and power supply circuitry. Inductors can be configured as a closed yoke design or a solenoid design. Closed yoke inductors have magnetic material wrapped around copper wires, and solenoid inductors have copper wire wrapped around magnetic material. In semiconductor-based integrated circuits (ICs), the performance of both inductor types benefit from forming the magnetic material as a relatively thick magnetic stack or yoke (e.g., magnetic layers having a total thickness of greater than about 200 nm).

Thick magnetic layers offer faster throughput and are can be deposited more efficiently than thinner magnetic layers. Additionally, as magnetic film thicknesses increase, the quality factor (also known as "Q") of the inductor also increases. The quality factor of an inductor is a measure of the inductor's efficiency. More specifically, Q is the ratio of the inductor's inductive reactance to its resistance at a given frequency. The maximum attainable quality factor for a given inductor across all frequencies is known as peak Q (or maximum Q). Some applications can require the peak Q to be at a low frequency and other applications can require the peak Q to be at a high frequency.

However, depositing thick magnetic layers (e.g., from about 50 nm to about 500 nm) on a wafer tend to impart a meaningful tensile stress (e.g., about 400 to about 500 mega-Pascals (MPa)) on the wafer. In addition, significant wafer bowing is generated for magnetic films with even smaller intrinsic stress because the total magnetic stack can be very thick (e.g., about 3 microns or more). Accordingly, although the intrinsic film stress of the magnetic films can be relatively small, the thickness of the stack as a whole can be very thick and this can cause severe wafer bowing. Wafer stress (tensile or compressive) within a certain range (e.g., below about 400 MPa) can under some circumstances result in wafer bow (positive or negative) that is tolerable. However, when the stress causes a wafer bow that is outside a tolerable range, the resulting wafer bow can cause problems with wafer alignment for lithography and wafer chucking on processing tools. As the deposited film's thickness is increased, the wafer stress and resulting wafer bow can becomes intolerably high.

FIG. 1 depicts three diagrams illustrating examples of a substantially unbowed wafer (top diagram), a positively bowed wafer (middle diagram), and a negatively bowed wafer (bottom diagram). One method for evaluating wafer bow is to measure the center point deviation (X) from a center point of a substantially planar wafer major surface (top or bottom) to a reference plane (RP). The top diagram illustrates an unbowed wafer, wherein the planar RP is substantially parallel with a planar top wafer major surface, and the wafer bow (X) is zero (0). The middle diagram illustrates a positively bowed wafer, wherein the planar RP is substantially non-parallel with a non-planar top wafer major surface, and the wafer bow (X) is positive (+). The positively bowed wafer is under tensile stress. The bottom diagram illustrates a negatively bowed wafer, wherein the planar RP is substantially non-parallel with a non-planar top wafer major surface, and the wafer bow (X) is negative (−). The negatively bowed wafer is under compressive stress.

Turning now to an overview of the aspects of the invention, one or more embodiments of the invention address the above-described shortcomings by providing methods of fabricating a laminated magnetic inductor having a yoke arrangement that includes multiple magnetic layer thicknesses. A fabrication method according to embodiments of the invention manage stress and wafer bow by depositing a thick compressive film over the entire wafer followed by the deposition of the tensile magnetic stack including the magnetic material and alternation dielectric layers to mitigate magnetic loss. Because the magnetic material stack is tensile, the stress can be balanced by the compressive dielectric material underneath. The stress can be balanced by choosing appropriate layer thicknesses for the compressive and tensile films. After the magnetic material is pattered and sections of the magnetic material are removed, removing sections of the magnetic material relaxes the tensile stress in the magnetic material. However, the compressive stress in the dielectric material is still very strong and can lead to excessive wafer bowing and misalignment or wafer chucking problems in subsequent processing operations (e.g., lithography processes, etc.). In order to relax the compressive stress in the dielectric material, the film can be etched down to the substrate such that a balance between the tensile magnetic material and compressive dielectric material is restored. In some embodiments of the invention, the compressive stress in the dielectric material can be relaxed by doping the compressive dielectric material.

Figure 2:
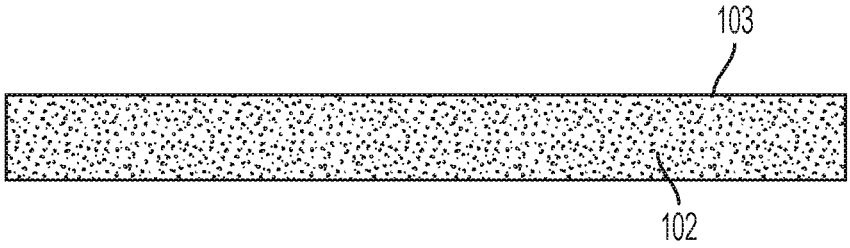
FIG. 2 depicts a cross-sectional view of a semiconductor wafer substrate of a yoke arrangement after an initial fabrication operation according to embodiments of the invention.

Turning now to a more detailed description of aspects of the present invention, FIG. 2 depicts a cross-sectional view of a semiconductor substrate/wafer 102 having a major surface 103 that forms the starting point for fabricating a magnetic stack or yoke arrangement according to embodiments of the invention. The substrate 102 can include a bulk silicon substrate or a silicon on insulator (SOI) wafer. The substrate 102 can be made of any suitable material, such as, for example, Ge, SiGe, GaAs, InP, AlGaAs, or InGaAs. In some embodiments of the invention, it is assumed that the semiconductor devices and individual circuits (ICs) (now shown) have been formed on the semiconductor the substrate/wafer 102. Semiconductor devices are formed on semiconductor wafers by depositing many types of thin films of material over the semiconductor wafers, patterning the thin films of material, doping selective regions of the semiconductor wafers, etc. CMOS (complementary metal-oxide semiconductor) is the semiconductor fabrication technology used in the transistors that are manufactured into most of today's computer microchips. In CMOS technology, both n-type and p-type transistors are used in a complementary way to form a current gate that forms an effective means of electrical control.

Semiconductor fabrication, traditionally including front-end-of-the-line (FEOL), middle-of-the-line (MOL), and back-end-of-the-line (BEOL), constitutes the entire process flow for manufacturing modern computer chips. FEOL manufacturing involves the formation of a plurality of die on the surface of a semiconductor wafer. Each semiconductor die is typically identical and contains circuits formed by electrically connecting active and passive components. The typical FEOL processes include wafer preparation, isolation, well formation, gate patterning, spacer, extension and source/drain implantation, silicide formation, and dual stress liner formation. The MOL is mainly gate contact (CA) formation. BEOL manufacturing involves singulating individual semiconductor die from the finished wafer and packaging the die to provide structural support and environmental isolation. The phrase "semiconductor die" as used herein refers to both the singular and plural form of the words, and accordingly can refer to both a single semiconductor device and multiple semiconductor devices.

Figure 3:
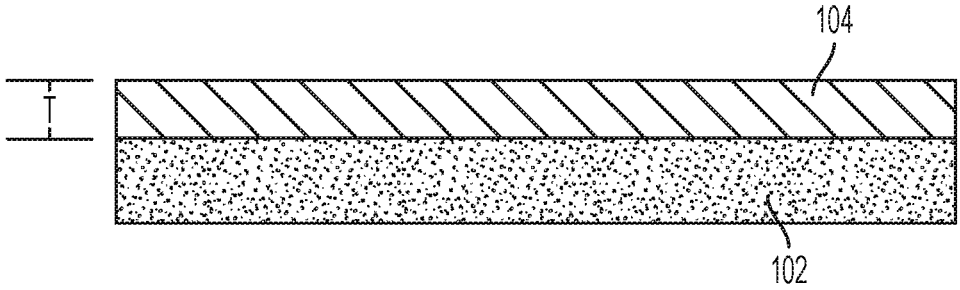
FIG. 3 depicts a cross-sectional view of portions of a yoke arrangement after a fabrication operation according to embodiments of the invention.

In FIG. 3, a relatively thick compressive dielectric layer 104 is formed opposite the major surface 103 (shown in FIG. 2) of the substrate 102 during an intermediate operation of a method of fabricating a semiconductor device according to embodiments of the invention. The compressive dielectric layer 104 can be any suitable material, such as, for example, silicon dioxide ($SiO_2$), silicon nitride (SiNi), and silicon oxynitride ($SiO_xN_y$). Any known manner of forming the compressive dielectric layer 104 can be utilized. In some embodiments of the invention, the compressive dielectric layer 104 can be formed using a sputter deposition process. The pressure and power of the sputter deposition process are controlled such that the dielectric layer 104 is relatively thick and has compressive properties. In some embodiments of the invention, the compressive stress of the dielectric layer 104 is from about minus 50 mega-Pascals (MPa) to about minus 500 MPa. In some embodiments of the invention, a thickness dimension (T') of the compressive dielectric layer 104 is from about 100 nm to about 2000 nm, although other thicknesses are within the contemplated scope of embodiments of the invention. At this stage of the fabrication process, the compressive dielectric layer 104 imparts compressive stress to the substrate 102. Although not depicted, in practice, the compressive stress imparted to the substrate 102 by the compressive dielectric layer 104 is sufficient to cause some portion of the substrate to bow downward in the shape of an upside down bowl.

Figure 4:
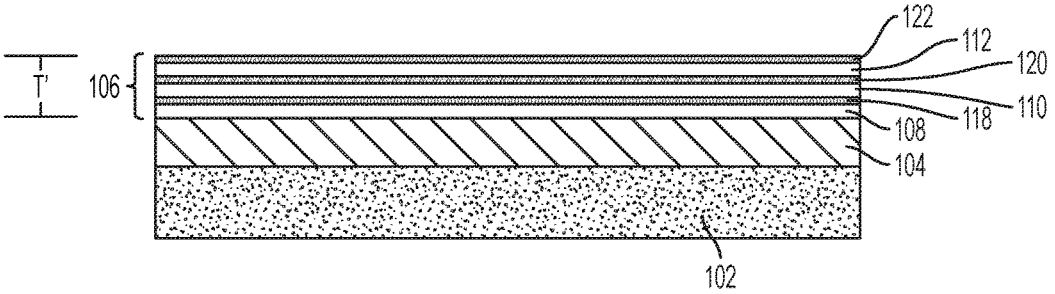
FIG. 4 depicts a cross-sectional view of portions of the yoke arrangement after a fabrication operation according to embodiments of the invention.

In FIG. 4 a magnetic stack 106 is formed on a side of the compressive dielectric layer 104 that is opposite the substrate 102. The magnetic stack 106 includes one or more magnetic layers (e.g., magnetic layers 108, 110, 112) alternating with one or more insulating layers (e.g., insulating layers 118, 120, 122). The magnetic stack 106 is formed by depositing alternating magnetic layers 108, 110, 112 and insulating layers 118, 120, 122. For ease of discussion and illustration, the magnetic stack 106 is depicted as having three magnetic layers 108, 110, 112 alternating with three insulating layers 118, 120, 122. However, the magnetic stack 106 can include any number of magnetic layers alternating with any corresponding number of insulating layers.

The insulating layers 118, 120, 122 isolate the adjacent magnetic material layers 108, 110, 112 from each other in the magnetic stack 106 and can be made of any suitable non-magnetic insulating material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the insulating layers 118, 120, 122 can be utilized. In some embodiments, the insulating layers 118, 120, 122 are formed on exposed surfaces of the magnetic layers 108, 110, 112, respectively, using a conformal deposition process such as PVD, CVD, PECVD, or a combination thereof. The insulating layers 118, 120, 122 can be significantly thinner than the magnetic layers 108, 110, 112, which are described in greater detail below. In some embodiments of the invention, the insulating layers 118, 120, 122 are formed to a thickness of about 5 nm to about 10 nm, although other thicknesses are within the contemplated scope of embodiments of the invention.

The magnetic layers 108, 110, 112 can be made of any suitable magnetic material known in the art, such as, for example, a ferromagnetic material, soft magnetic material, iron alloy, nickel alloy, cobalt alloy, ferrites, plated materials such as permalloy, or any suitable combination of these materials. In some embodiments of the invention, the magnetic layers 108, 110, 112 include a Co containing magnetic material, FeTaN, FeNi, FeAlO, or combinations thereof. Any known manner of forming the magnetic layers 108, 110, 112 can be utilized. The magnetic layers 108, 110, 112 can be deposited through vacuum deposition technologies (i.e., sputtering) or electrodepositing through an aqueous solution. In some embodiments of the invention, the pressure and power of the sputter deposition process are controlled such that the magnetic layers 108, 110, 112 are thick enough to, collectively, have tensile properties. In some embodiments of the invention, the collective tensile stress of the magnetic layers 108, 110, 112 is such that the total tensile stress of the magnetic stack 106 (taking into account the insulating layers 118, 120, 122) counters or balances the compressive stress provided by the compressive dielectric layer 104. For example, where the compressive stress from the compressive dielectric layer 104 is from about minus 50 mega-Pascals (MPa) to about minus 500 MPa, the magnetic layers 108, 110, 112, the tensile stress from the magnetic sack 106 is such that it provides a sufficient counter to the compressive stress and falls within the range from about 50 MPa to about 500 MPa. In some embodiments of the invention, a thickness dimension (T) of the magnetic stack 106 is from about 5 nm to about 500 nm, although other thicknesses are within the contemplated scope of embodiments of the invention.

A net effect of the compressive stress from the compressive dielectric layer 104 and the tensile stress from the tensile magnetic stack 106 is insufficient to cause a portion of the major surface of the substrate 102 to be substantially non-planar. More specifically, when the net effect of the above-described compressive and tensile stresses are insufficient to cause the major surface of the substrate 102 to be substantially non-planar, the net effect of these stresses on the wafer is within a certain range (e.g., wafer bow X between positive less than about 60 microns and negative less than the absolute value of about −60 microns). Under some circumstances such a wafer bow X level is tolerable in that it is insufficient to cause problems with wafer alignment for lithography and wafer chucking on processing tools.

Figure 5:
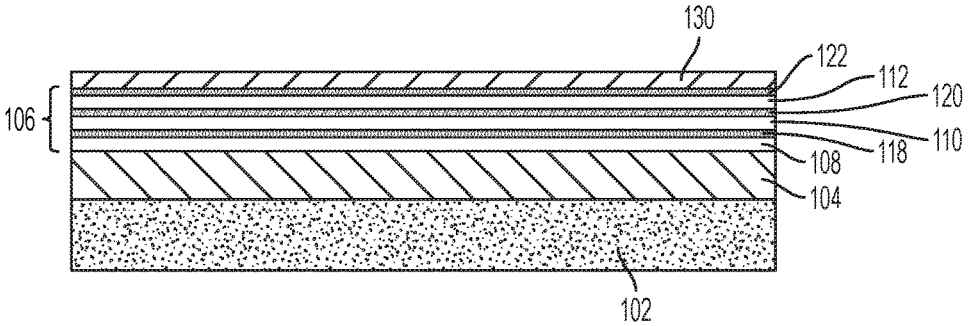
FIG. 5 depicts a cross-sectional view of portions of portions of the yoke arrangement after a fabrication operation according to embodiments of the invention.

In FIG. 5, a hard mask layer 130 on a side of the magnetic stack 106 that is opposite the compressive dielectric layer 104. Hard mask layer 130 can be formed from a dielectric material, for example, an oxide, an oxide precursor, or a nitride. Non-limiting examples of materials for forming hard mask layer 130 include silicon dioxide, silicon nitride, tetraethylorthosilicate (TEOS) oxide, high aspect ratio plasma (HARP) oxide, high temperature oxide (HTO), high density plasma (HDP) oxide, or any combination thereof. Hard mask layer 130 can be formed using a deposition process, including, but not limited to chemical vapor deposition (CVD), physical vapor deposition (PVD), plasma enhanced CVD (PECVD), atomic layer deposition (ALD), evaporation, chemical solution deposition, and/or other like processes.

Figure 6:
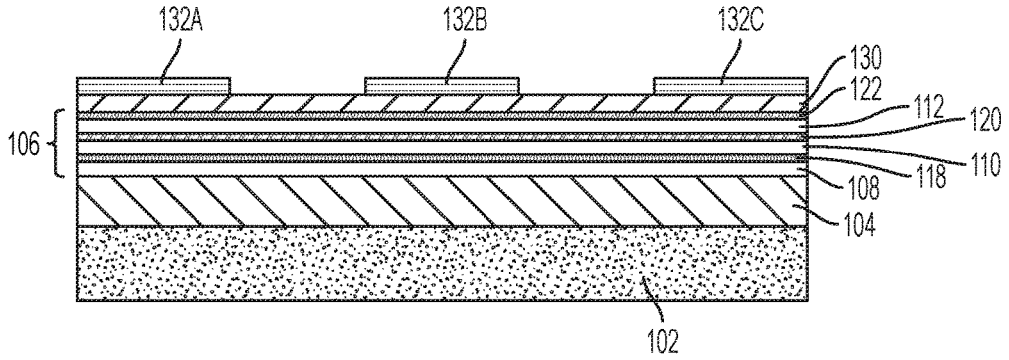
FIG. 6 depicts a cross-sectional view of portions of portions of the yoke arrangement after a fabrication operation according to embodiments of the invention.
Figure 7:
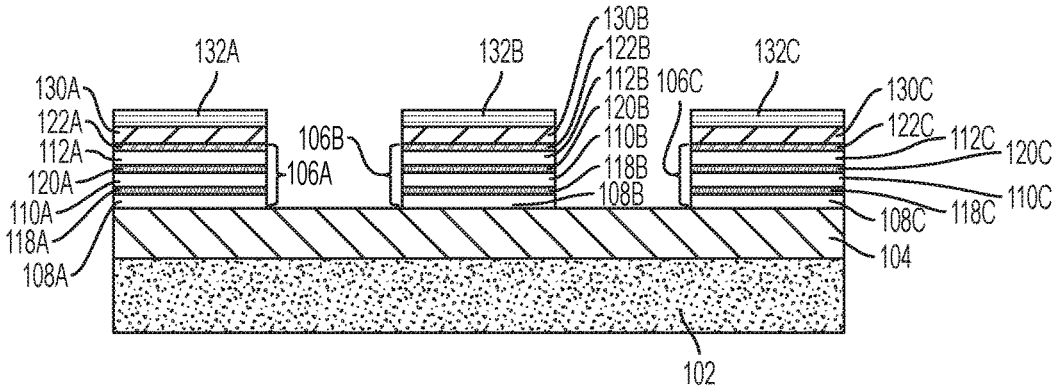
FIG. 7 depicts a cross-sectional view of portions of portions of the yoke arrangement after a fabrication operation according to embodiments of the invention.

In FIG. 6, photo-resist layers 132A, 132B, 132C are formed over the hard mask layer 130. In FIG. 7, the spaces between each photo-resist layer 132A, 132B, 132C defines areas of the hard mask layer 130 and the magnetic stack 106 that have been removed (e.g., through etching) to form individual magnetic stacks 106A, 106B, 106C that will each through subsequent processing form part of the yoke arrangement of an individual inductor. Any known removal method can be used, such as, for example, a wet etch, a dry etch, or a combination of sequential wet and/or dry etches.

Figure 8:
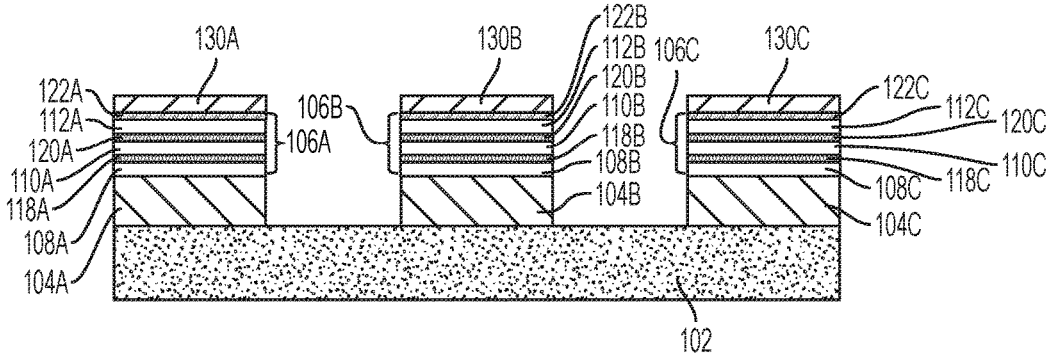
FIG. 8 depicts a cross-sectional view of portions of portions of the yoke arrangement after a fabrication operation according to embodiments of the invention.

After the processing operation depicted in FIG. 7, the previously-described net effect of or balance between the compressive stress from the compressive dielectric layer 104 and the tensile stress from the tensile magnetic stack 106 has been disturbed because removing portions of the magnetic stack 106 relaxes the tensile stress such that the collective tensile stress of the magnetic stacks 106A, 106B, 106C is less than the tensile stress of the magnetic stack 106. In FIG. 8, the net effect of or balance between the compressive stress from the compressive dielectric layer 104 and the tensile stress from the tensile magnetic stacks 106A, 106B, 106C is restored by applying an etch process to the compressive dielectric layer 104 to form individual compressive dielectric layers 104A, 104B, 104C. The net effect of or balance between the compressive stress from the compressive dielectric layers 104A, 104B, 104C and the tensile stress from the tensile magnetic stack 106A, 106B, 106C is now insufficient to cause a portion of the major surface of the substrate 102 to be substantially non-planar. More specifically, when the net effect of the above-described compressive and tensile stresses are insufficient to cause the major surface of the substrate 102 to be substantially non-planar, the net effect of these stresses on the wafer is within a certain range (e.g., wafer bow X between positive less than about 60 microns and negative less than the absolute value of about −60 microns). Under some circumstances, such a wafer bow X level is tolerable in that it is insufficient to cause problems with wafer alignment for lithography and wafer chucking on processing tools for a particular application.

Figure 9:
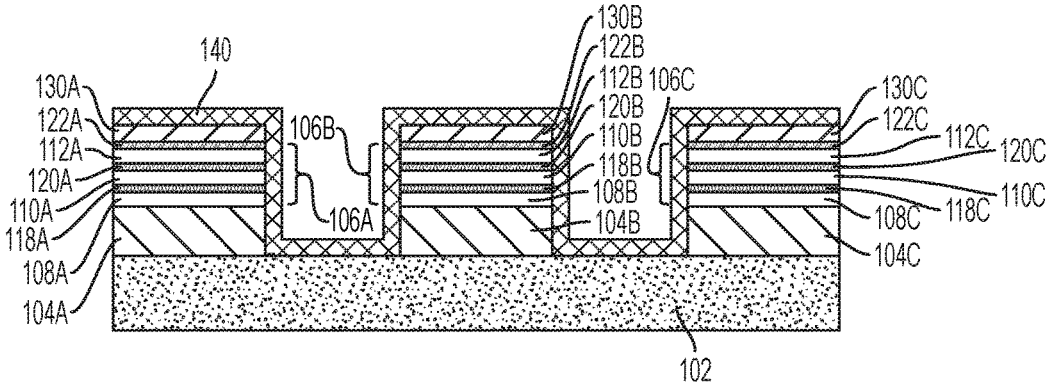
FIG. 9 depicts a cross-sectional view of portions of portions of the yoke arrangement after a fabrication operation according to embodiments of the invention.

In FIG. 9, a dielectric isolation layer 140 is deposited over and around the hard masks 130A, 130B, 130C, the tensile magnetic stacks 106A, 106B, 106C, and the compressive dielectric layers 104A, 104B, 104C to provide isolation of each magnetic stack 106A, 106B, 106C. In some embodiments of the invention, the hard masks 130A, 130B, 130C can be removed prior to forming the dielectric isolation layer 140. Each compressive dielectric layer 104A, 104B, 104C and magnetic stack 106A, 106B, 106C form the yoke arrangement for an individual inductor. Subsequent processing operations (e.g., forming one or more coils) are performed on the yoke arrangements in a conventional manner to form a finished inductor device.

Figure 10:
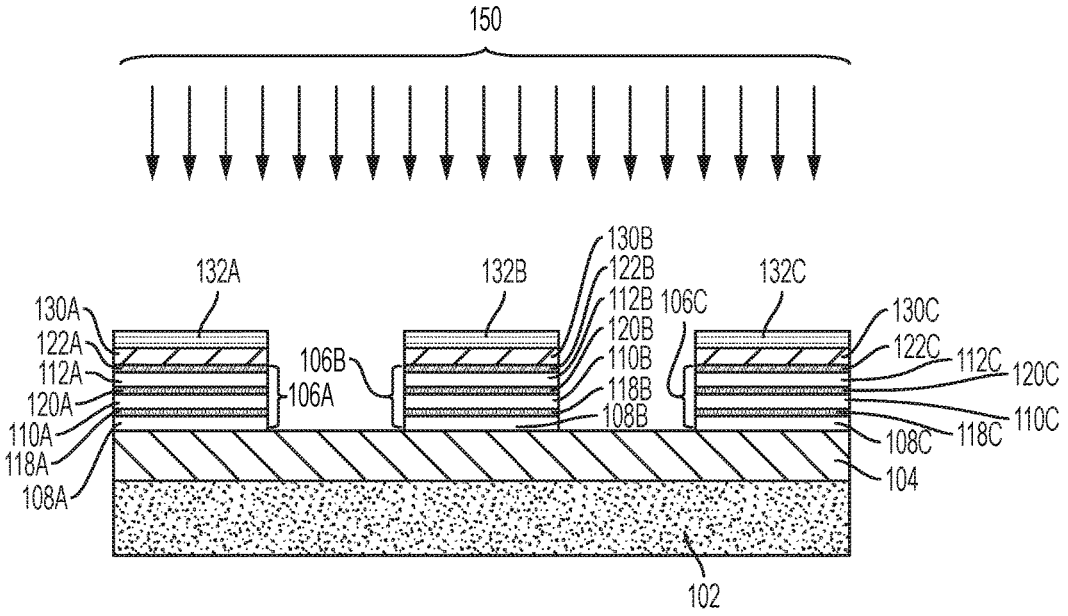
FIG. 10 depicts a cross-sectional view of portions of portions of the yoke arrangement after a fabrication operation according to embodiments of the invention.

As previously noted herein, after the processing operation depicted in FIG. 7, the previously-described net effect of or balance between the compressive stress from the compressive dielectric layer 104 and the tensile stress from the tensile magnetic stack 106 has been disturbed because removing portions of the magnetic stack 106 relaxes the tensile stress such that the collective tensile stress of the magnetic stacks 106A, 106B, 106C is less than the tensile stress of the magnetic stack 106. In FIG. 10, the net effect of or balance between the compressive stress from the compressive dielectric layer 104 and the tensile stress from the tensile magnetic stacks 106A, 106B, 106C is restored by providing dopants 150 (by implantation or other suitable methods) into the compressive dielectric layer 104 to relax the compressive stress in the compressive dielectric layer 104. In some embodiments of the invention, the dopants 150 can also be provided at angles other than 90 degrees with respect to a top major surface of the compressive dielectric layer 104 to insert some dopants 150 into the regions of the compressive dielectric layer 104 that are under the magnetic stacks 106A, 106B, 106C. Suitable dopants 150 include Xe, Ar, Kr, Ge, Si, Ne. The doping is continued until the net effect of or balance between the compressive stress from the doped compressive dielectric layer 104 and the tensile stress from the tensile magnetic stack 106A, 106B, 106C is insufficient to cause a portion of the major surface of the substrate 102 to be substantially non-planar. More specifically, when the net effect of the above-described compressive and tensile stresses are insufficient to cause the major surface of the substrate 102 to be substantially non-planar, the net effect of these stresses on the wafer is within a certain range (e.g., wafer bow X between positive less than about 60 microns and negative less than the absolute value of about −60 microns. Under some circumstances such a wafer bow X level is tolerable in that it is insufficient to cause problems with wafer alignment for lithography and wafer chucking on processing tools.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The phrase "selective to," such as, for example, "a first element selective to a second element," means that the first element can be etched and the second element can act as an etch stop.

The term "conformal" (e.g., a conformal layer) means that the thickness of the layer is substantially the same on all surfaces, or that the thickness variation is less than 15% of the nominal thickness of the layer.

The flowchart and block diagrams in the Figures illustrate possible implementations of fabrication and/or operation methods according to various embodiments of the present invention. Various functions/operations of the method are represented in the flow diagram by blocks. In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A method of fabricating a yoke arrangement of an inductor, the method comprising:

forming a dielectric layer across from a major surface of a substrate;

configuring the dielectric layer such that it imparts a predetermined dielectric layer compressive stress on the substrate;

forming a magnetic stack on an opposite side of the dielectric layer from the substrate, wherein the magnetic stack comprises one or more magnetic layers alternating with one or more insulating layers;

configuring the magnetic stack such that it imparts a predetermined magnetic stack tensile stress on the dielectric layer; and further configuring the magnetic stack to comprise a relaxed magnetic stack having a relaxed predetermined magnetic stack tensile stress;

wherein a net effect of the predetermined dielectric layer compressive stress and the predetermined magnetic stack tensile stress on the substrate is insufficient to cause a portion of the major surface of the substrate to be substantially non-planar.

2. The method of claim 1, wherein the dielectric layer comprises a dielectric material selected from the group consisting of silicon dioxide ($SiO_2$), silicon nitride (SiN), and silicon oxynitride ($SiO_xNy$).

3. The method of claim 1, wherein a thickness dimension of the dielectric layer comprises from about 1 micron to about 5 microns.

4. The method of claim 1, wherein the predetermined dielectric layer compressive stress comprises from about minus 50 mega-Pascals (MPa) to about minus 500 MPa.

5. The method of claim 1, wherein a thickness dimension of the magnetic stack comprises from about 1 micron to about 5 microns.

6. The method of claim 1, wherein the predetermined magnetic stack tensile stress comprises from about 50 mega-Pascals (MPa) to about 500 MPa.

7. The method of claim 1 further comprising configuring the dielectric layer to comprise a relaxed dielectric layer having a relaxed predetermined dielectric layer compressive stress.

8. The method of claim 7, wherein a net effect of the relaxed predetermined dielectric layer compressive stress and the predetermined magnetic stack tensile stress on the substrate is insufficient to cause a portion of the major surface of the substrate to be substantially non-planar.

9. The method of claim 7, wherein further configuring the dielectric layer comprising removing a portion of the dielectric layer.

10. The method of claim 9, wherein the relaxed dielectric layer comprises a predetermined length dimension.

11. The method of claim 7, wherein further configuring the dielectric layer comprises providing dopant into the dielectric layer.

12. The method of claim 11, wherein providing the dopants comprises providing the dopant at an angle with respect to the major surface of the substrate.

13. The method of claim 1, wherein further configuring the magnetic stack comprises removing a portion of the magnetic stack.

14. The method of claim 13, wherein the relaxed magnetic stack comprises a predetermined length dimension.

* * * * *